United States Patent [19]

Anderson et al.

[11] 4,352,331

[45] Oct. 5, 1982

[54] RAILWAY HOPPER CAR

[75] Inventors: Arthur I. Anderson, St. Paul; Louis J. Harvatin, Minneapolis, both of Minn.

[73] Assignee: North American Car Corporation, Chicago, Ill.

[21] Appl. No.: 144,848

[22] Filed: Apr. 29, 1980

[51] Int. Cl.[3] ..... B61D 7/00; B61D 7/32; B65G 53/04

[52] U.S. Cl. ..... 105/248; 105/358; 105/360; 406/138

[58] Field of Search ..... 105/248, 358, 360, 406 R; 406/138

[56] References Cited

U.S. PATENT DOCUMENTS

| | | | |
|---|---|---|---|
| 1,365,216 | 1/1921 | Anderson | 105/248 |
| 1,605,943 | 11/1926 | Hart | 105/406 R X |
| 1,630,001 | 5/1927 | Gardner | 105/406 R |
| 3,277,843 | 10/1966 | Horner et al. | 105/360 |
| 3,427,994 | 2/1969 | Keene | 105/248 |
| 3,515,051 | 6/1970 | Pulcrano | 105/360 X |
| 3,583,331 | 6/1971 | Mowatt-Larssen | 105/248 X |
| 3,713,399 | 1/1973 | Bembridge et al. | 105/248 X |
| 4,189,262 | 2/1980 | Anderson | 406/136 |

*Primary Examiner*—Joseph F. Peters, Jr.
*Assistant Examiner*—Howard Beltran
*Attorney, Agent, or Firm*—Lockwood, Dewey, Alex & Cummings

[57] ABSTRACT

A rail car includes substantially flat plate extensions interposed between upper and lower sections of the shell of the car to increase the internal volume of the car. The extensions are supported by lateral supports which extend laterally in the interior of the car and by longitudinal support beams also in the car interior which extend longitudinally of the extensions, are intersected by the lateral supports, and substantially prevent internal pressure in the car from being applied to the extensions.

23 Claims, 10 Drawing Figures

RAILWAY HOPPER CAR

BACKGROUND OF THE INVENTION

The present invention relates in general to material transportation cars, and, more particularly, to railroad cars.

The AAR has specific regulations regarding sizes and structures of railway cars. To most efficiently utilize a car, the volume and load capabilities thereof must be maximized within the restraints of AAR regulations. For example, a longer car is permitted if width is decreased correspondingly. However, the weight of a car increases as that car is lengthened. Thus, to achieve a payload in excess of 193,000 pounds, the car cannot exceed 70,000 pounds.

Thus, there is need for a means of increasing the volume of existing cars while remaining within the requirements set by the AAR.

SUMMARY OF THE INVENTION

The device of the present invention permits increasing the volume of a 4,000 cubic foot car, referred to hereinafter as PD 4,000, to greater than 5,000 cubic feet while still remaining within the requirements set by the AAR, and having pressure holding capabilities up to 15 psi with proper safety factors, such as factors which permit personnel in the close vicinity of the car.

The device includes a planar section located in the unitary, integral, arcuate shell of a car. The shell is reinforced longitudinally and laterally of the car. The center section of the car is isolated by allowing the upper and lower sections of the car to function as pressure shells without changing the shape of those sections.

The planar section is not exposed to pressure established internally of the car, that is the pressure of the product, air or other fluid. The pressure is applied to the surface of the longitudinally extending support means. Vents are included so that a dead air space defined by the longitudinal support means is at atmospheric pressure.

The lateral support means includes a cross tie which is end abutted against a ring covering the plates.

OBJECTS OF THE INVENTION

It is a main object of the present invention to increase the volume of an existing rail car while remaining within the constraints set by the AAR.

It is another object of the present invention to increase the volume of an existing rail car while remaining within the constraints set by the AAR and to provide secure pressure retention capability for that rail car.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
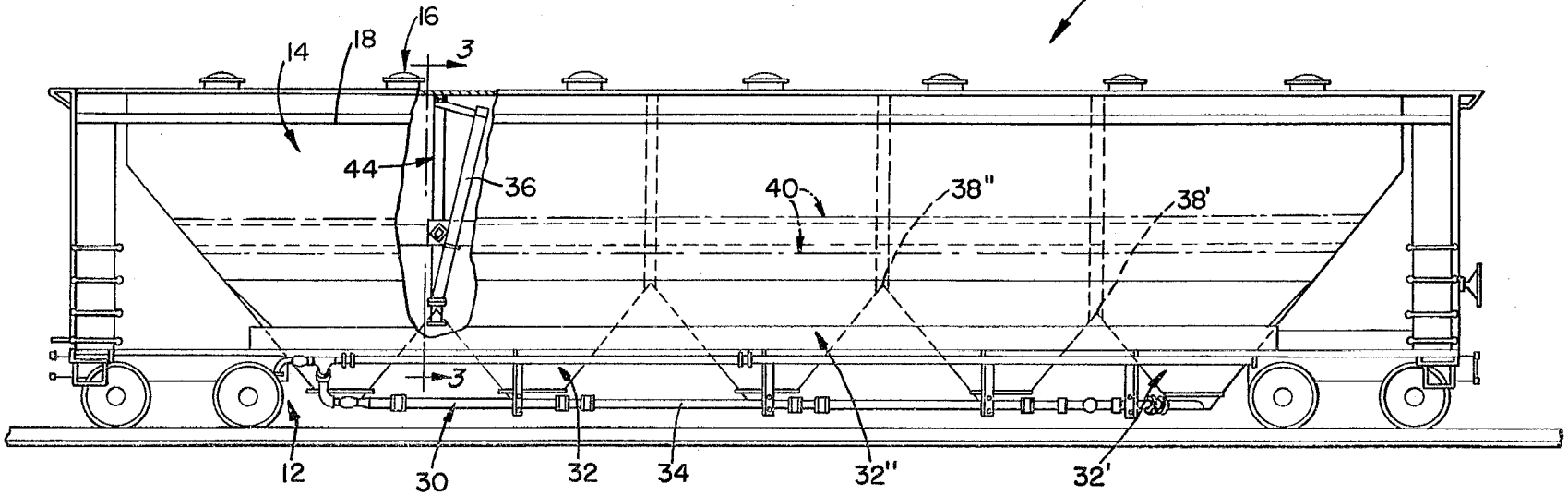
FIG. 1 is a side elevation of a railroad car embodying the teachings of the present invention.
Figure 2:
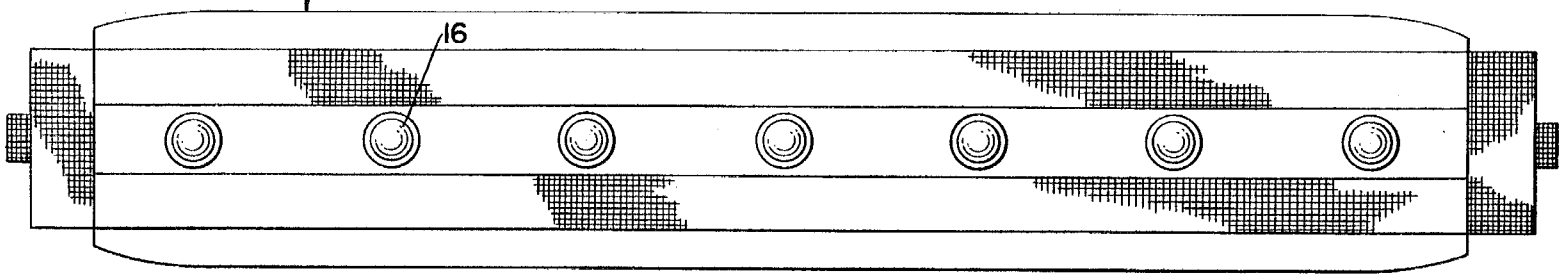
FIG. 2 is a top plan view of a railroad car embodying the teachings of the present invention.
Figure 3:
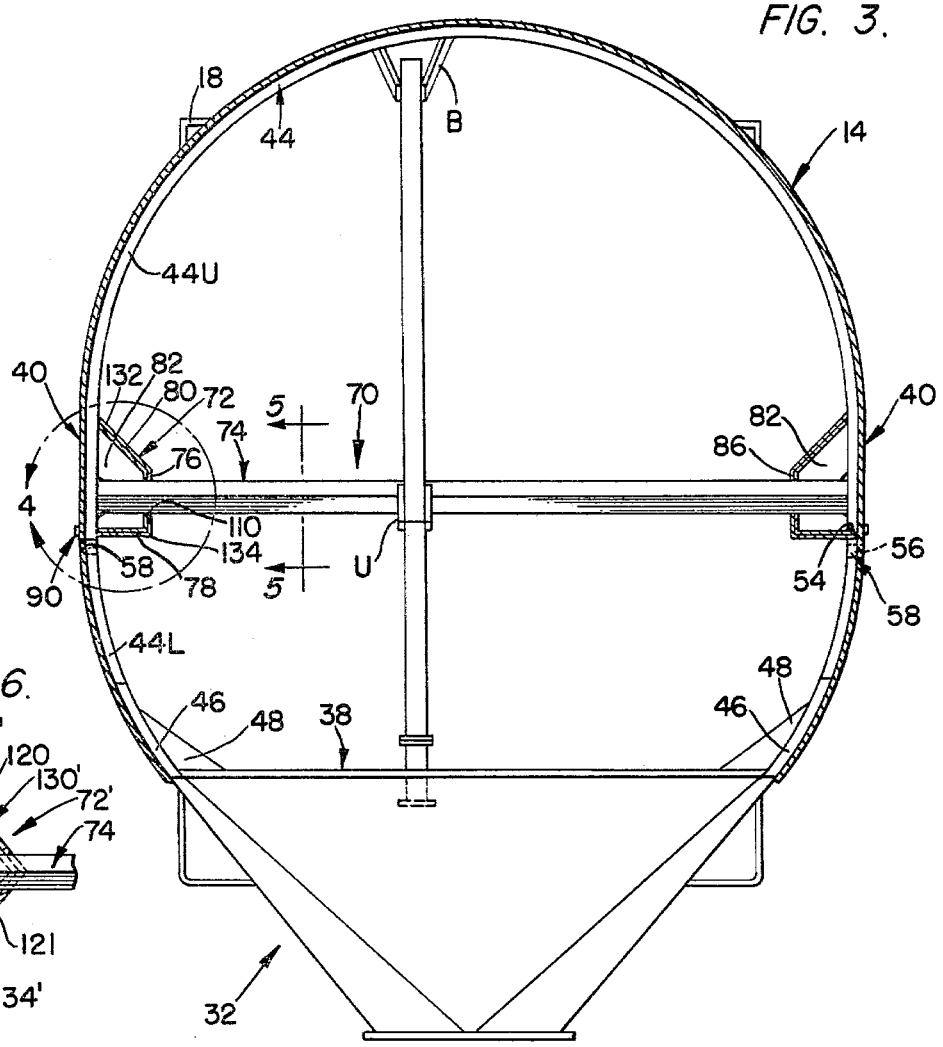
FIG. 3 is a view taken along line 3—3 of FIG. 1.

Shown in FIG. 1 is a rail car 10 for use in transporting material such as dry product which can include flour, sugar, starch and the like. It is also noted that the car 10 can be adapted to transport slurries by using the teachings of U.S. Pat. No. 4,189,262. The car 10 includes undercarriage 12, unitary shell 14 and a plurality of manholes 16, as well as a top rail assembly 18. A product discharge system 30 includes a plurality of hoppers 32, piping 34 and standpipe assembly 36. As shown in FIG. 3, the standpipe assembly is supported by brackets B and U-bolt brackets U. As best shown in FIG. 1, the hoppers 32 are of varying heights. For example, hopper 32' and hopper 32" have different heights, and thus apex 38' of the hopper 32' is at a different level than apex 38" of the hopper 32". This varying hopper height is a result of the increased volume of the car 10.

The car shell is unitary and includes flat or planar plate extension sections 40 in the shell thereof to increase the volume of that car. As best shown in FIG. 3, the flat sections cause the car 10 to assume the shape of a truncated prolate spheroid in transverse cross-section. The hopper is located in the truncated portion of the car.

Figure 8:
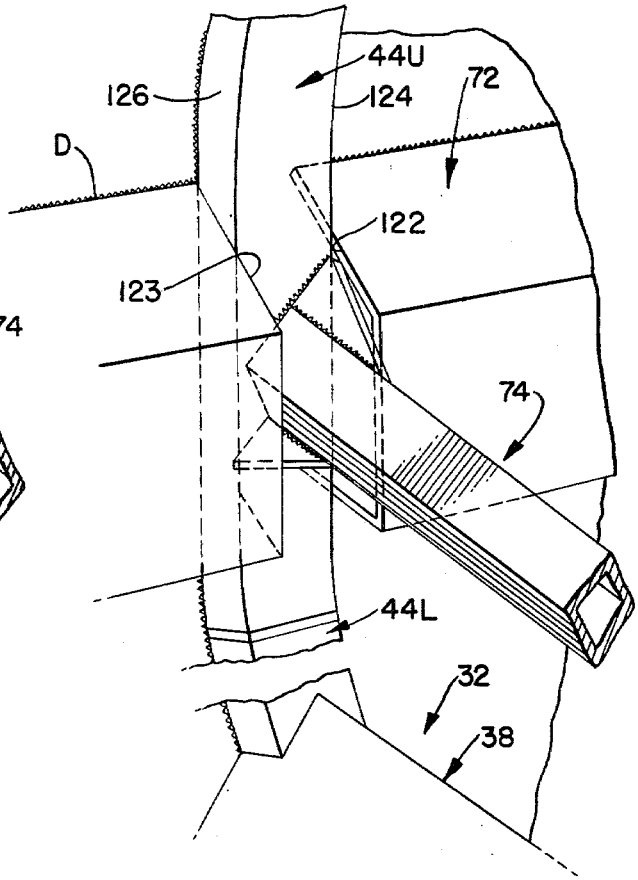
FIG. 8 is a perspective of a cross tie, a longitudinal support beam and a retention ring used in the railroad car embodying the teachings of the present invention.

Each of the flat sections is elongate and extends longitudinally of the car for essentially the entire length of the car, as indicated in FIG. 1. As shown in FIG. 3, the internal structure of the car includes an internal ring 44, which is preferably channel shaped, which extends transversely of the car and is arcuate in shape to follow the arcuate shape of the car shell 14. The lower ends of those rings that are located adjacent a hopper are cut away to accommodate apex 38 of a hopper, as best shown in FIG. 8. A channel filler 46 is located on each end of the ring, and a gusset 48 is located adjacent the channel filler. A plurality of rings are included in the car at longitudinally spaced locations thereof. The car 10 has a continuous and uninterrupted or clear interior. That is, there are no internal bulkheads, or the like, located within the car 10, and the car 10 is not divided into compartments, but is an open volume. However, it is noted that baffles and/or bulkheads can be installed if so desired. The internal rings maintain the sectional shape of the car.

Each ring 44 includes an upper section 44U and a lower section 44L having ends 52 and 54, respectively. A splice piece 58 is attached as by welding 59, or the like, to the ring to fixedly connect the ring upper and lower sections together. Preferably, the splice piece is a channel bracket.

A planar section reinforcement system 70 includes a beam 72 extending the length of the car and associated with the planar section, and a cross tie 74 extending laterally across the car. The beam 72 is a longitudinal support means and the cross tie 74 is a lateral support system. The rings 44 are located at the intersection of those support means.

Figure 4:
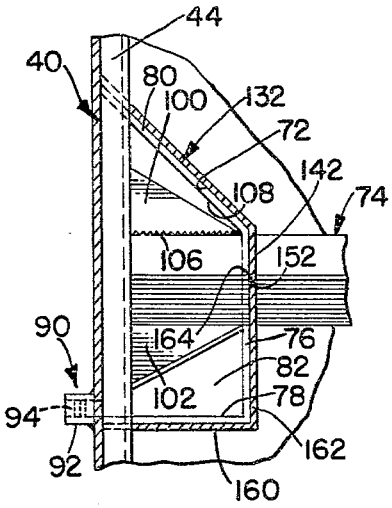
FIG. 4 is a view taken along line 4 of FIG. 3.

As best shown in FIGS. 3 and 4, the beam 72 is approximately U-shaped in transverse cross-section and includes a web 76 to which is integrally coupled leg 78 and leg 80, with leg 78 being essentially perpendicular to the web and the leg 80 being upwardly inclined therefrom. The upward inclination of the leg 80 facilitates product flow over the beam during discharge of the product from the car. The beam is hollow thereby defining a dead air space 82. The beam legs are attached, as by welding, or the like, to the shell of the car so that the planar section 40 is not exposed to internal pressure established within the car 10. This pressure is applied, instead, to the outer surface of the beam 72.

A vent 90 includes a coupling 92 located outside the car 10 and a bore 94 fluidly connected to the vent to fluidly connect the dead air space 82 with the atmosphere. The dead air space can thus be vented to atmosphere so that atmospheric pressure is established within the beam dead air space.

Figure 5:
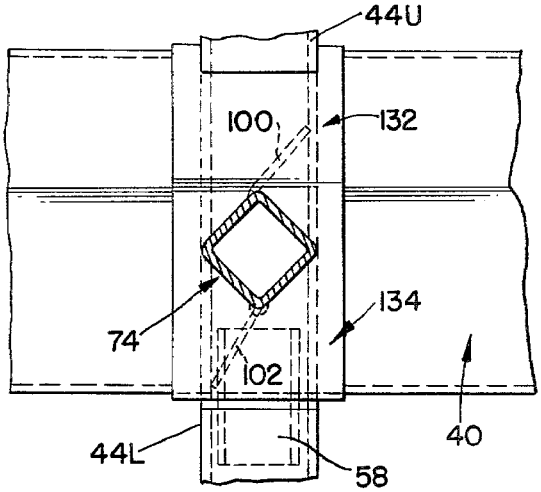
FIG. 5 is a view taken along line 5—5 of FIG. 3.

As best shown in FIG. 5, the cross tie 74 is polygonal in transverse cross-section and includes a pair of gussets 100 and 102 which are attached at one end to the tie 74 and which are inclined longitudinally of the car. The gussets are located at the terminal ends of the tie and are right triangular in shape with the base 106 thereof attached to the tie 74 by welding, or the like. The gussets have a height along the base 106 which is essentially equal to the distance between the internal ring and the inner surface 108 of the beam 72. As shown in FIG. 5, the gussets are clockwise inclined from the tie 74 as viewed along line 5—5, and structurally connect the tie 74 to the ring 44. Preferably, the tie is hollow.

As shown in FIG. 3, the tie has the ends thereof abutting the rings 44 to reinforce the planar portions against collapse laterally of the car.

A prototype car having a scale weight of about 69,400 pounds has attained a volume of 5,148 cubic feet while using planar portions and selected hopper spacings to increase the volume of a PD 4,000 car, and a pressure of 22.5 psi with a load of 320,000 pounds of water. Preferably, the planar portions are about 19 inches in width from top to bottom. It is also noted that many parts of one car can be interchanged with parts of other cars.

Figure 6:
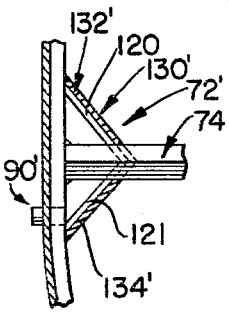
FIG. 6 is an alternative embodiment of the support structure used in the railroad car embodying the teachings of the present invention.

An alternative embodiment of the present invention is shown in FIG. 6, and includes a beam 72' which is V-shaped in cross section. The beam 72' is similar to beam 72 in all other respects, and includes a vent 90'. The angle between legs 120 and 121 of the beam 72' is greater than 90°, and, preferably, is approximately 100°. Thus material movement over leg 120 is facilitated.

Assembly of the reinforcing ring and cross tie is best shown in FIGS. 7–10, and attention is now directed to those figures.

Figure 7:
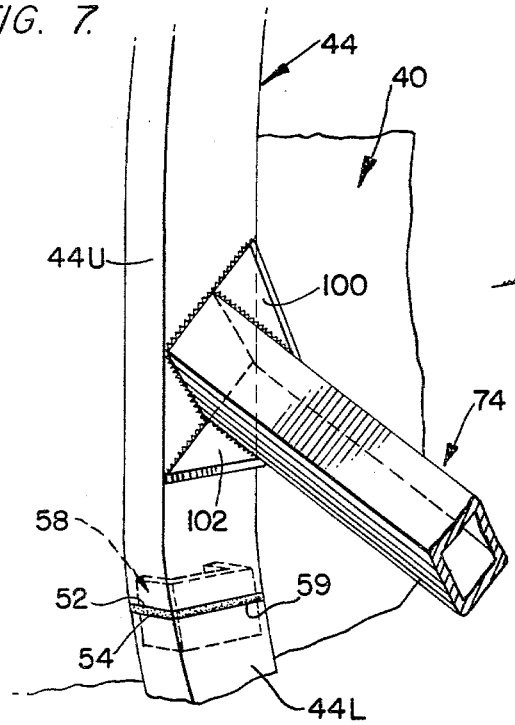
FIG. 7 is a perspective of a cross tie and a retention ring used in the railroad car embodying the teachings of the present invention.

The cross tie is welded to the ring 44 as shown in FIG. 7 and as discussed above. The beam 72 is also affixed to the shell of the car to cover the flat section 40 thereof. Welds D, or the like, can be ussed to attach the beam to the car shell. The beam is separated to accommodate the rings 44, and thus, adjacent each ring, the beam has ends 122 and 123 which abut sides 124 and 126, respectively, of the ring 44.

A cover member 130 includes a top cap 132 and a bottom cap 134. The top cap is integral and includes a sloping body member 140 and a downwardly depending flange 142. The slope of the top cap body with respect to the flange is essentially equal to the slope of leg 80 with respect to web 76 of the beam 72.

Figure 9:
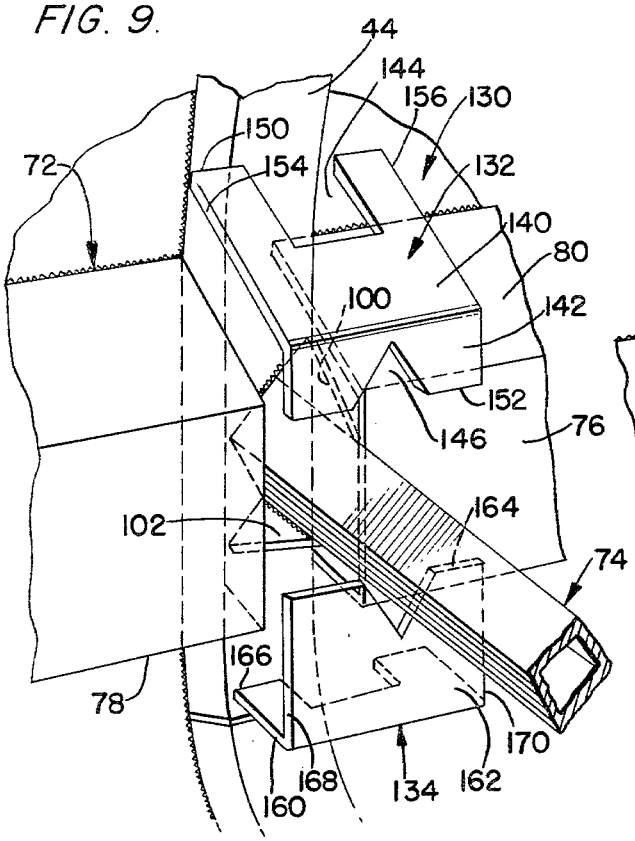
FIG. 9 is an exploded perspective of the FIG. 8 elements plus a cover.

A rectangular cutout portion 144 is defined in the top cap body to snugly accommodate the ring 44, and an angular cutout portion 146 is defined in the flange 142 to snugly accommodate the cross tie 74. The top cap body has rear end edge 150, front end edge 152 and side edges 154 and 156 as best shown in FIG. 9.

The bottom cap is similar to the top cap except that body 160 thereof is at essentially a right angle with respect to bottom cap flange 162 to match the orientation of beam bottom 78 with respect to beam web 76. The bottom cap has end edges 164 and 166 and side edges 168 and 170 as shown in FIG. 9.

Figure 10:
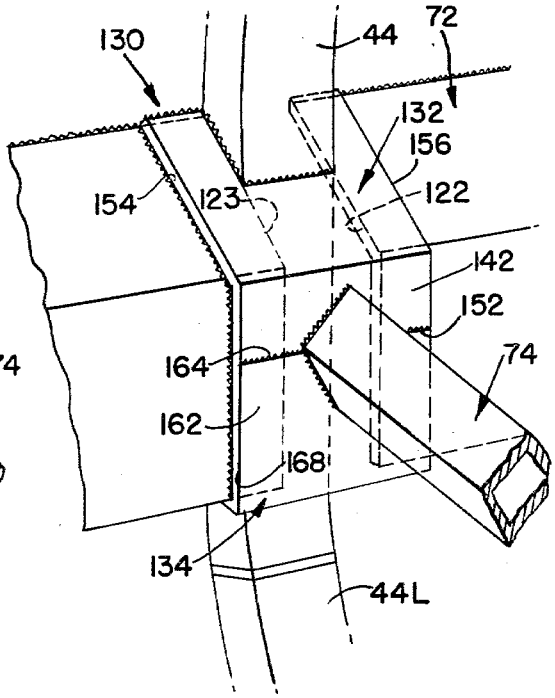
FIG. 10 is a perspective showing the junction of the longitudinal and lateral supports used in the railroad car embodying the teachings of the present invention.

The top and bottom caps are attached to the car shell, to the beam, to the ring, and to each other at edges 152 and 164 as shown in FIG. 10 by welding or the like, along all the edges of the caps.

A cover similar to the just-described cover can be used with the FIG. 6 embodiment. Such a cover will have both body portions sloped to form an angle at the junction thereof of greater than 100° to accommodate the beam 72'. The cover member 130' is shown in FIG. 6 to include top cap 132' and bottom cap 134'. No flanges similar to flanges 142 and 162 are present in the cover member 130', so cutout portions similar to the cutout portion 146 of the member 130 are defined in the body of the member 130' to accommodate the cross tie 74. Cutouts similar to cutouts 144 of the member 130 are also defined in the member 130' to accommodate ring 44. The cover member 130' is attached to the longitudinal and lateral support members 72 and 74, respectively, at the junction thereof and at the junction of those members and the ring 44 in a manner similar to the aforediscussed attachment of the cover member 130 to those elements, that is, welds or the like can be used.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A railroad car comprising:

an elongate shell having an upper section and a lower section;

extension means interposed between said shell upper and lower sections to increase the volume of the railroad car;

lateral support means extending laterally of said shell for supporting said extension means; and longitudinal support means intersecting said lateral support means and contacting said shell at said extension means, and extending longitudinally of said shell for substantially preventing pressure established internally of said shell from being applied to said extension means.

2. The railroad car defined in claim 1 wherein said extension means includes a planar plate extending longitudinally of said shell.

3. The railroad car defined in claim 1 wherein said longitudinal support means is closed to the interior of the car, and vent means for venting the closed interior of said longitudinal support means to the exterior of the car.

4. The railroad car as defined in claim 1 wherein said elongate shell is capable of withstanding pressures other than atmospheric.

5. The railroad car defined in claim 1 wherein said lateral support means includes a cross tie which extends diametrically of said shell between said extension means on either end of said cross tie.

6. The railroad car defined in claim 5 wherein said cross tie is polygonal in transverse cross-section.

7. The railroad car defined in claim 5 wherein said cross tie further includes gusset plates attached thereto.

8. The railroad car defined in claim 7 wherein said gusset plates are triangular.

9. The railroad car defined in claim 8 wherein said gusset plates are sloped longitudinally of said shell.

10. The railroad car defined in claim 1 wherein said longitudinal support means includes a U-shaped beam.

11. The railroad car defined in claim 10 wherein said longitudinal support means further includes a vent fluidly coupling only the internal area defined by said U-shaped beam with the atmosphere.

12. The railroad car defined in claim 1 further including an internal ring on an inner surface of said shell intersecting said longitudinal support means.

13. The railroad car defined in claim 12 wherein said lateral support means is connected to said internal ring.

14. The railroad car defined in claim 1 wherein said longitudinal support means includes a V-shaped beam.

15. The railroad car defined in claim 14 wherein said beam has an included angle of greater than a right angle.

16. The railroad car defined in claim 1 further including a cover member located at the intersection of said longitudinal and lateral support means.

17. The railroad car defined in claim 16 wherein said longitudinal support means comprises a beam having an included angle of greater than a right angle.

18. The railroad car defined in claim 1 including a plurality of hoppers, the railroad car having a continuous and clear interior.

19. The railroad car defined in claim 18 wherein said hoppers are conical and have a plurality of heights.

20. A railroad car comprising:

an elongate shell having an upper section and a lower section;

extension means interposed between said shell upper and lower sections to increase the volume of the railroad car;

lateral support means extending laterally of said shell for supporting said extension means; and longitudinal support means intersecting said lateral support means and contacting said shell at said extension means and extending longitudinally of said shell.

21. The railroad car as defined in claim 20 wherein said extension means is substantially planar.

22. The railroad car as defined in claim 20 further including an internal ring on an inner surface of said shell and intersecting said longitudinal support means, and said lateral support means also intersects said internal ring.

23. The railroad car as defined in claim 20 wherein said elongate shell is capable of withstanding pressures other than atmospheric.

* * * * *